US005344055A

United States Patent [19]

Edwards

[11] Patent Number: 5,344,055

[45] Date of Patent: Sep. 6, 1994

[54] BOTTLE HOLDER ACCESSORY FOR AN INLINE ROLLERSKATE

[76] Inventor: David A. Edwards, 3025 Broadway, #37, Boulder, Colo. 80304

[21] Appl. No.: 105,642

[22] Filed: Aug. 12, 1993

[51] Int. Cl.[5] ..... B60R 7/00

[52] U.S. Cl. ..... 224/42.45 R; 224/273; 280/816

[58] Field of Search ..... 224/42.45 R, 30 A, 32 R, 224/33 A, 34, 35, 36, 39, 40, 41, 273; 36/136; 280/11.22, 11.23, 811, 809, 816

[56] References Cited

U.S. PATENT DOCUMENTS

| | | | |
|---|---|---|---|
| 2,583,550 | 1/1952 | Dennis et al. | 224/32 R |
| 3,791,563 | 2/1974 | Raat | 224/39 |
| 4,230,245 | 10/1980 | Pold et al. | 224/39 |
| 4,570,835 | 2/1986 | Criqui et al. | 224/36 |
| 4,957,227 | 9/1990 | Trimble | 224/32 R |
| 5,253,883 | 10/1993 | Moldenhauer | 280/11.22 |

*Primary Examiner*—Henry J. Recla
*Assistant Examiner*—David J. Walczak
*Attorney, Agent, or Firm*—John R. Flanagan

[57] ABSTRACT

A bottle holder accessory for an inline rollerskate includes a holder structure adapted to hold a water bottle and a support structure adapted to mount the holder structure to the inline rollerskate. The bottle holder structure has a lower portion adapted to receive the water bottle therein and an upper portion adapted to releasably secure the water bottle on the lower portion. The support structure has a bracket adapted to support the bottle holder structure in a cantilevered position rearwardly of the bracket and a pair of laterally-spaced attachment arms connected to the lower end of the bracket and extending generally forwardly therefrom. The attachment arms are adapted to extend along and be fastened to opposite sides of a mobile undercarriage of the inline rollerskate. Elongated slots are defined in the attachment arms to receive at least some of the opposite ends of the axles which rotatably mount the wheels of the undercarriage. Also, fasteners are used to secure the opposite ends of the axles extending outwardly through the slots to the attachment arms and thereby mount the bottle holder accessory to opposite ends of the axles.

18 Claims, 2 Drawing Sheets

12
14
34
38
36
24
S
40
10
28
32
16
18
4
22
20
48
44
30
B
50
46
26
42

BOTTLE HOLDER ACCESSORY FOR AN INLINE ROLLERSKATE

BACKGROUND OF THE INVENTION

1. Field of the Invention

The present invention generally relates to a beverage container holder and, more particularly, is concerned with a bottle holder accessory adapted, in particular, for an inline rollerskate.

2. Description of the Prior Art

Physical activities, such running, bicycling and golfing, make the participants thirsty. A widespread practice is for participants to carry a water bottle so that it will be easily accessible during the activity.

In the case of running, several different bottle holder designs have been proposed in the prior patent art which carry the bottle on the runner's body. Examples of such holders are the ones disclosed in U.S. patents to Boretsky et al (U.S. Pat. No. 4,974,762) and Lahr (U.S. Pat. No. 5,056,696).

In the case of bicycling, many different bottle holder designs have been proposed in the prior patent art which carry the bottle at some location on the bicycle frame. Several examples of such holders are the ones disclosed in U.S. patents to Rowe (U.S. Pat. No. 4,095,812) , Boughton (U.S. Pat. No. 4,345,704), Criqui et al (U.S. Pat. No. 4,570,835), Opfergelt (U.S. Pat. No. 4,754,902), Reichert et al (U.S. Pat. No. 5,024,358) and Endre (U.S. Pat. No. 5,178,308).

In the case of golfing, a bottle holder design has been proposed in the prior patent art which carries the bottle on the golf bag. An example of such holder is the one disclosed in U.S. patent to Patton (U.S. Pat. No. 5,105,958).

Rollerskating is a physical activity which has been enjoyed for many years. A more recent form of this activity involves the use of inline rollerskates which permits participants to reach greater speeds than with traditional rollerskates. Heretofore, participants have had to carry a water bottle on their bodies. Because participants are typically poised in a bent or tucked position during inline rollerskating activity, wearing the holder for the bottle on the participant's body is uncomfortable.

Consequently, a need still exists for a different approach to carrying a water bottle during participation in inline rollerskating activity.

SUMMARY OF THE INVENTION

The present invention provides a bottle holder accessory designed to satisfy the aforementioned need. The bottle holder accessory of the present invention is adapted for employment on an inline rollerskate itself rather than on the body of the skater. The bottle holder accessory utilizes a pair of mounting arms which adapt the accessory to be mounted on inline rollerskates of different sizes by being mounted on the outer ends of the axles of the inline rollerskate.

Accordingly, the present invention is directed to a bottle holder accessory for an inline rollerskate which comprises: (a) a holder structure adapted to hold a water bottle; and (b) a support structure adapted to mount the holder structure to an inline rollerskate. The support structure has a rear portion attached to the holder structure to support the holder structure and the water bottle therewith in a position rearwardly of and above the support structure and rearwardly of the inline rollerskate. The support structure also has a forward portion including a pair of elongated arms spaced below the holder structure and connected to the rear portion of the support structure. The elongated arms extend forwardly from the rear portion and are laterally spaced apart so as to be extendable along and releasably attachable to opposite sides of the inline rollerskate.

The present invention also in directed to the combination of a bottle holder accessory with an inline rollerskate. The inline rollerskate has a boot and a mobile undercarriage supporting the boot. The mobile undercarriage includes a carriage frame, a plurality of wheels, and a plurality of transverse axles rotatably mounting the wheels to the carriage frame in a fore-and-aft tandem alignment relative to one another. The bottle holder accessory includes a holder structure having a lower portion adapted to receive a water bottle and an upper portion adapted to releasably secure the water bottle in the lower portion thereof, and a support structure having a rear portion adapted to support the holder structure and the water bottle therewith in a position rearwardly of the inline rollerskate. The support structure also has a forward portion spaced below and forwardly of the holder structure and rigidly attached to the rear portion. The forward portion is releasably attached to the inline rollerskate.

More particularly, the forward portion of the support structure includes a pair of elongated arms connected to the rear portion and being laterally spaced apart and extending generally forwardly therefrom to along opposite sides of the mobile undercarriage of the inline rollerskate. The elongated arms have a plurality of elongated slots defined therein. The accessory also includes a plurality of fasteners releasably attaching the elongated arms to opposite ends of at least some the axles of the mobile undercarriage of the inline rollerskate which extend outwardly through the slots of the elongated arms.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figures 1, 2, 3:
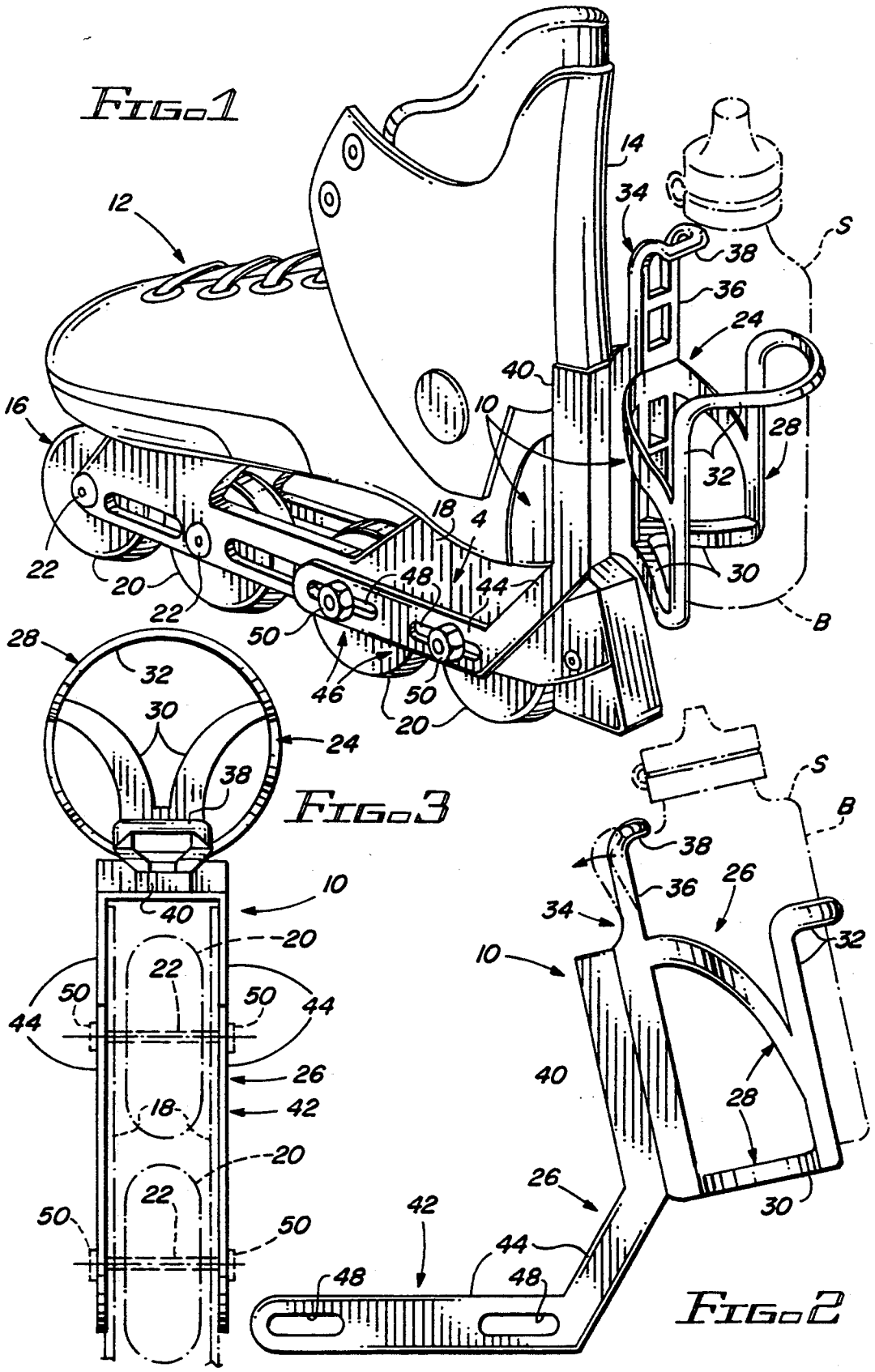
FIG. 1 is a rear perspective view of a first embodiment of an inline rollerskate having the bottle holder accessory of the present invention mounted thereon.
FIG. 2 is an enlarged side elevational view of the bottle holder accessory of the present invention removed from the inline rollerskate.
FIG. 3 is a top plan view of the bottle holder accessory of FIG. 2.
Figure 4:
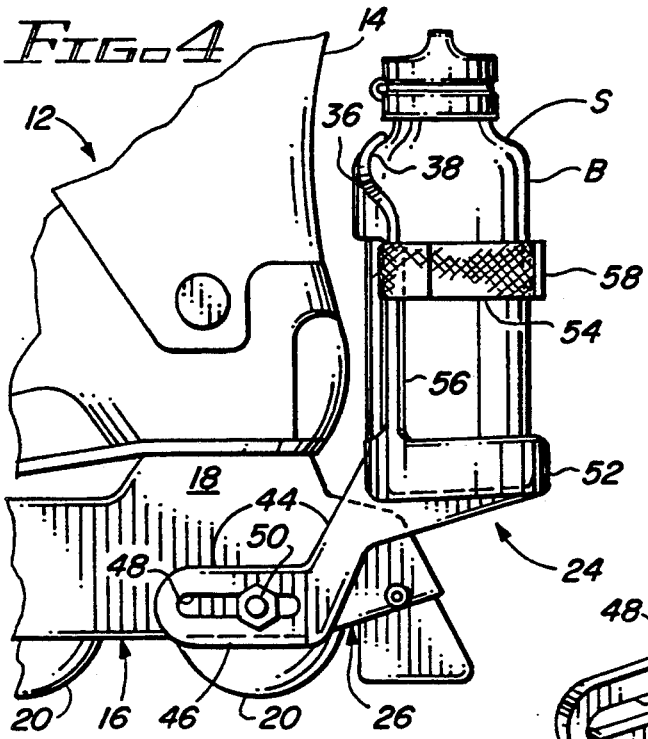
FIG. 4 is a side elevational view of a second embodiment of the bottle holder accessory of the present invention.
Figure 5:
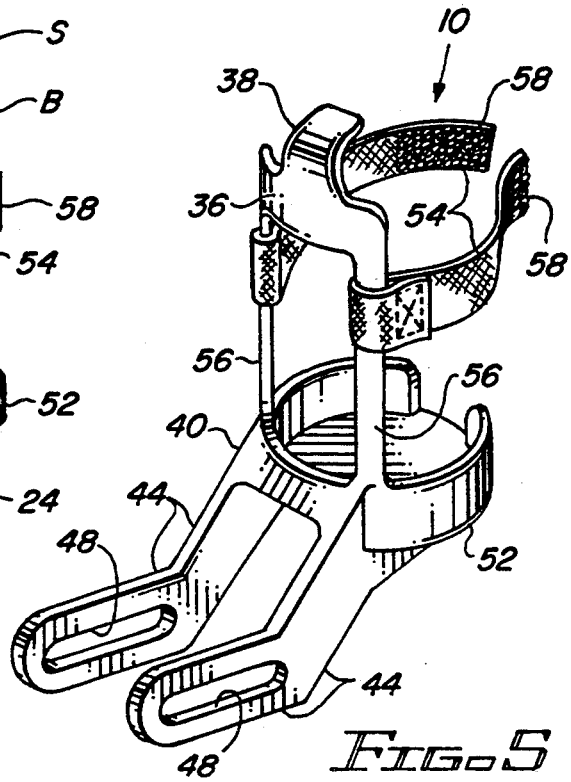
FIG. 5 is a perspective view of the bottle holder accessory of FIG. 4 removed from the inline rollerskate.
Figure 6:
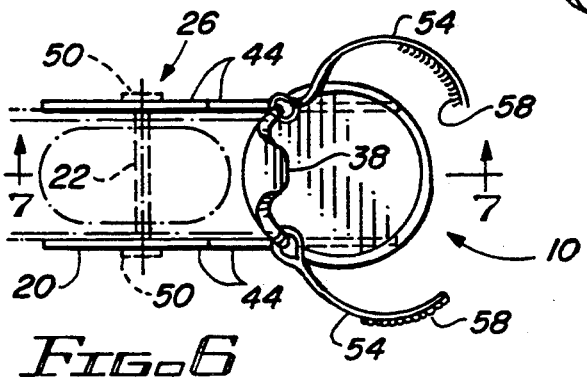
FIG. 6 is a top plan view of the bottle holder accessory of FIG. 5.
Figure 7:
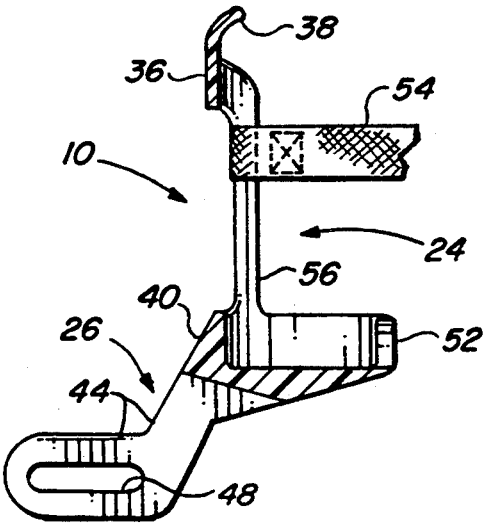
FIG. 7 is a vertical sectional view of the bottle holder taken along line 7—7 of FIG. 6.

Referring to the drawings and particularly to FIGS. 1 to 3, there is illustrated a first embodiment of a bottle holder accessory, generally designated 10, of the present invention particularly adapted for mounting on a conventional inline rollerskate 12. The inline rollerskate 12 typically includes a boot 14 and a mobile undercarriage 16 fastened on the bottom of the boot and supporting the boot above it for receiving a wearer's foot. The mobile undercarriage 16 has an elongated carriage frame 18, a plurality of wheels 20, and a plurality of transverse axles 22 rotatably mounting the wheels 20 to the carriage frame 18 in a fore-and-aft tandem alignment relative to one another.

Referring again to FIGS. 1–3, the bottle holder accessory 10 basically includes a holder structure 24 adapted to hold a water bottle B and a support structure 26 attached to the holder structure 24 and adapted to mount the holder structure 24 to the inline rollerskate 12. The holder structure 24 of the accessory 10 includes a lower portion 28 having a V-shaped platform or base 30 adapted to receive the water bottle B with its bottom end resting thereon. The lower portion 28 of the holder structure 24 also has an annular or arcuate-shaped cage 32 attached to the seat 30 and extending upwardly therefrom and being adapted to hold the water bottle B in an upright orientation on the seat 32.

The holder structure 24 of the accessory 10 also includes an upper portion 34 extending above the lower portion 28 and being adapted to releasably secure the water bottle B on the lower portion 28. The upper portion 34 of the holder structure 24 includes a latch member 36 made of resiliently and yieldably flexible material and having an upper hook 38 adapted to overlie an upper shoulder portion S of the water bottle.

The support structure 26 of the accessory 10 includes a rear portion 40 in the form of a bracket 40 attached to and adapted to support the holder structure 14 in a generally cantilevered relationship at a rearward side of the bracket 40. The support structure 26 also includes a forward portion 42 in the form of a pair of elongated attachment arms 44 connected to and extending downwardly and forwardly from the rear bracket 40. The elongated arms 44 are laterally spaced apart from one another and extend generally parallel to one another. The laterally spacing between and length of the arms 44 are selected so as to adapt them to be extendable along and fastenable at opposite sides of carriage frame 18 of the mobile undercarriage 16 of the inline rollerskate 12.

Also, the bottle holder accessory 10 includes means 46 for releasably attaching the pair of elongated arms 44 to the opposite sides of the carriage frame 18 of the mobile undercarriage 16. Preferably, the attaching means 46 take the form of plurality of elongated slots 48 and a plurality of fasteners 50. The elongated slots 48 are defined in the arms 44 so as to adapt opposite ends of selected ones of the axles 22 which rotatably mount the wheels 20 to the carriage frame 18 to extend through the slots 48. The fasteners 50 are used to secure the opposite ends of the axles 22 which extend outwardly through the slots 48 to the elongated arms 44 and thereby mount the bottle holder accessory 10, via the support structure 26 to opposite ends of the axles 22. The elongated character of the slots 48 in the arms 44 permit the bottle holder accessory 10 to fit inline rollerskates of different sizes.

Referring to FIGS. 4–7, there is illustrated a second embodiment of a bottle holder accessory 10 which also has the holder structure 24 and support structure 26. The support structure 26 of the second embodiment of the accessory 10 is substantially the same as that of the first embodiment of the accessory 10 described above. However, the lower portion 28 of the holder structure 24 of the second embodiment has a shallow cup-shaped base 52 for seating the water bottle B and a pair of flexible straps 54 adapted for extension about the water bottle. The flexible straps 54 are attached at inner ends about a pair of upstanding legs 56 of the upper portion 34 of the holder structure 24. The flexible straps 54 have respective patches 58 of complementary hook and loop releasable fastening material applied at least to respective outer ends of the straps 54.

It is thought that the present invention and its advantages will be understood from the foregoing description and it will be apparent that various changes may be made thereto without departing from its spirit and scope of the invention or sacrificing all of its material advantages, the form hereinbefore described being merely preferred or exemplary embodiment thereof.

I claim:

1. A bottle holder accessory for an inline rollerskate, comprising:

(a) a holder structure adapted to hold a water bottle; and (b) a support structure adapted to mount said holder structure to an inline rollerskate, said support structure having a rear portion attached to said holder structure to support said holder structure and the water bottle therewith in a position rearwardly of and above said support structure and rearwardly of the inline rollerskate, said support structure also having a forward portion including a pair of elongated arms spaced forwardly of and below said holder structure and connected to said rear portion of said support structure, said elongated arms extending forwardly from said rear portion and being laterally spaced apart and adapted to extend along and releasably attach to opposite sides of the inline rollerskate, said arms having respective elongated slots defined therein being adapted to receive fasteners for releasably securing said elongated arms to predetermined attachment locations on opposite sides of the inline rollerskate, said slots being elongated in directions extending parallel to and along said arms so as to adapt said arms to be adjustably movable in forward and rearward directions relative to the predetermined attachment locations on the opposite sides of the inline rollerskate and thereby change the position of said holder structure toward and away a rear end of the inline rollerskate.

2. The accessory of claim 1 wherein said holder structure includes a lower portion adapted to receive and support the water bottle.

3. The accessory of claim 2 wherein said holder structure also includes an upper portion spaced above said lower portion and being adapted to releasably secure the water bottle on said lower portion.

4. A bottle holder accessory for an inline rollerskate, comprising:

(a) a holder structure adapted to hold a water bottle; and (b) a support structure adapted to mount said holder structure to an inline rollerskate, said support structure having a rear portion attached to said holder structure to support said holder structure and the water bottle therewith in a position rearwardly of and above said support structure and rearwardly of the inline rollerskate, said support structure also having a forward portion including a pair of elongated arms spaced forwardly of and below said holder structure and connected to said rear portion of said support structure, said elongated arms extending forwardly from said rear portion and being laterally spaced apart so as to be extendable along and releasably attachable to opposite sides of the inline rollerskate;

(c) said holder structure including a lower portion adapted to receive and support the water bottle and an upper portion spaced above said lower portion and being adapted to releasably secure the water bottle on said lower portion, said upper portion of said holder structure including a resiliently and yieldably flexible latch member having an upper hook for overlying a portion of the water bottle.

5. A bottle holder accessory for an inline rollerskate, comprising:

(a) a holder structure adapted to hold a water bottle; and (b) a support structure adapted to mount said holder structure to an inline rollerskate, said support structure having a rear portion attached to said holder structure to support said holder structure and the water bottle therewith in a position rearwardly of and above said support structure and rearwardly of the inline rollerskate, said support structure also having a forward portion including a pair of elongated arms spaced forwardly of and below said holder structure and connected to said rear portion of said support structure, said elongated arms extending forwardly from said rear portion and being laterally spaced apart so as to be extendable along and releasably attachable to opposite sides of the inline rollerskate;

(c) said holder structure including a lower portion adapted to receive and support the water bottle and an upper portion spaced above said lower portion and being adapted to releasably secure the water bottle on said lower portion, said lower portion adapted for extension about the water bottle.

6. The accessory of claim 5 wherein said flexible straps have patches of complementary releasably fastening material applied at least to respective ends of said straps.

7. The accessory of claim 1 wherein said rear portion of said support structure includes a bracket extending between said holder structure and elongated arms and supporting said holder structure in a cantilevered relationship on a rearward side of said bracket.

8. The accessory of claim 1 wherein said attaching means includes fasteners adapted to attach said elongated arms to opposite ends of at least some a plurality of axles which rotatably mount a plurality of wheels on a carriage frame of the inline rollerskate and extend outwardly through said slots of said elongated arms.

9. A bottle holder accessory, comprising:

(a) a holder structure having a lower portion adapted to receive and support a water bottle and an upper portion adapted to releasably lock the water bottle thereon;

(b) a mounting structure having a bracket adapted to support said holder structure in a position on a rearward side of the bracket and a pair of elongated arms spaced apart laterally and extending generally parallel to one another, said elongated arms being connected to a lower end of said bracket and extending generally forwardly therefrom and adapted to fit along opposite sides of an undercarriage of an inline rollerskate; and (c) means for releasably attaching said elongated arms to opposite sides of the undercarriage, said attaching means including respective elongated slots defined in said arms and being adapted to receive fasteners for releasably securing said elongated arms to predetermined attachment locations on opposite sides of the inline rollerskate, said slots being elongated in directions extending parallel to and along said arms so as to adapt said arms to be adjustably movable in forward and rearward directions relative to the predetermined attachment locations on the opposite sides of the inline rollerskate and thereby permit said accessory to fit inline rollerskates at different positions along said slots so as to accommodate inline rollerskates of different lengths.

10. The accessory of claim 9 wherein said holder structure includes a lower portion adapted to receive and support the water bottle and an upper portion spaced above said lower portion and being adapted to releasably secure the water bottle on said lower portion.

11. The accessory of claim 10 wherein said upper portion of said holder structure .includes a resiliently and yieldably flexible latch member having an upper hook adapted to overlie a portion of the water bottle.

12. The accessory of claim 10 wherein said lower portion of said holder structure includes a pair of flexible straps adapted for extension about the water bottle.

13. The accessory of claim 12 wherein said flexible straps have patches of complementary releasably fastening material applied at least to respective ends of said straps.

14. In combination with an inline rollerskate having a boot and a mobile undercarriage supporting said boot, said mobile undercarriage including a carriage frame, a plurality of wheels, and a plurality of transverse axles rotatably mounting said wheels to said carriage frame in a fore-and-aft tandem alignment relative to one another, a bottle holder accessory comprising:

(a) a holder structure having a lower portion adapted to receive a water bottle and an upper portion adapted to releasably secure the water bottle on said lower portion thereof; and (b) a support structure having a rear portion adapted to support said holder structure and the water bottle therewith in a position rearwardly of the inline rollerskate, said support structure also having a forward portion spaced below and forwardly of said holder structure and attached to said rear portion, said forward portion being releasably attached to the inline rollerskate such that said rear portion of said support structure supports said holder structure and the water bottle therewith in said position rearwardly of the inline rollerskate.

15. The combination of claim 14 wherein said forward portion of said support structure includes a pair of elongated arms connected to said rear portion and being laterally spaced apart and extending generally forwardly therefrom to along opposite sides of said mobile undercarriage of said inline rollerskate.

16. The combination of claim 15 wherein said rear portion of said support structure includes a bracket extending between said holder structure and said elongated arms and supporting said holder structure in a cantilevered relationship on a rearward side of said bracket.

17. The combination of claim 15 wherein said arms have a plurality of elongated slots defined therein.

18. The combination of claim 17 further comprising:

a plurality of fasteners releasably attaching said elongated arms to opposite ends of at least some said axles of said mobile undercarriage of said inline rollerskate extending outwardly through said slots of said elongated arms.

* * * * *